US005720392A

United States Patent [19]

Price

[11] Patent Number: 5,720,392

[45] Date of Patent: Feb. 24, 1998

[54] PRESCRIPTION TIMER

[76] Inventor: Harvey D. Price, 3011 Coquina Esplanade, Punta Gorda, Fla. 33982

[21] Appl. No.: 704,407

[22] Filed: Aug. 23, 1996

Related U.S. Application Data

[60] Provisional application No. 60/006,286, Nov. 7, 1995

[51] Int. Cl.[6] ..... B65D 83/04; B65D 85/00; G09F 9/00

[52] U.S. Cl. ..... 206/534; 40/311; 116/308; 116/309; 206/459.1; 215/230

[58] Field of Search ..... 215/230, 220; 40/311; 116/308, 309, 311; 206/534, 459.1

[56] References Cited

U.S. PATENT DOCUMENTS

| | | | |
|---|---|---|---|
| 2,111,637 | 3/1938 | Mehaffey | 116/308 |
| 2,817,451 | 12/1957 | Giles et al. | 215/230 |
| 3,446,179 | 5/1969 | Bender | 206/534 X |
| 3,960,713 | 6/1976 | Carey | 206/534 |
| 4,041,628 | 8/1977 | Sasson | 116/308 X |
| 4,345,541 | 8/1982 | Villa-Real | 116/308 |
| 4,347,804 | 9/1982 | Villa-Real | 116/308 |
| 4,511,050 | 4/1985 | Nicol | 206/534 X |
| 4,641,759 | 2/1987 | Kelley | 215/220 |
| 4,749,093 | 6/1988 | Trick | 215/220 |
| 4,920,912 | 5/1990 | Kirkling | 116/308 |
| 5,577,335 | 11/1996 | Tucker | 40/311 |

FOREIGN PATENT DOCUMENTS

| | | | |
|---|---|---|---|
| 407409 | 4/1964 | Switzerland | 206/534 |

*Primary Examiner*—Bryon P. Gehman
*Attorney, Agent, or Firm*—Frank A. Lukasik

[57] ABSTRACT

The present invention is a device for indicating when a person either took a pill or other medication, or when he is scheduled to take the next dose of the medication. The invention is conveniently attached to a pill bottle having a cap. An image of a clock face is printed on or adhered to the top of the bottle cap and/or the bottom and may include either a MEDICATION TAKEN AT image or a MEDICATION DUE AT image. A transparent, rotatable cap, having an arrow indicator inscribed thereon, is placed over the bottle cap. A second transparent, rotatable cap, having an arrow indicator inscribed thereon may be placed over a clock face image and a medication image on the bottom for use as a second timer reminder. When a medication is taken, the rotatable cover covering the MEDICATION TAKEN AT end is turned to the time taken. The opposite end timer is then turned to the MEDICATION DUE AT end to indicate when the next dose is due.

3 Claims, 5 Drawing Sheets

PRESCRIPTION TIMER

RELATED APPLICATION

This application claims the benefit of U.S. provisional application Ser. No. 60/006286, filed Nov. 7, 1995.

BACKGROUND OF THE INVENTION

1. Field of the Invention

This invention relates generally to a device for indicating when a prescription medicine is taken or when it should be taken and in particular, the invention provides a clock face and indicator to denote the time medication is taken and and a clock face and indicator to denote when the next dose is due.

2. Discussion of the Prior Art

Statistics have shown that many individuals taking on medication, either overdose by taking the prescription too soon or are not sufficiently medicated because they wait too long between doses. This is especially true of older persons who do not have the mental faculties of a younger person. In addition, the timing of several different types of medications complicates the coordination of the various medications. The timing problem is especially acute in the case of home care. Each day a new nurse or attendant arrives, it is important for them to know when the last medication was taken and when the next dose is due. Clocks or other timing devices would not have the memory required to keep exact times for medication. Furthermore, some elderly persons would not have the mental capacity nor skills required for setting sophisticated timing devices.

SUMMARY OF THE INVENTION

Accordingly, it is an object of the invention to provide a directly readable device for indicating the time medication was taken and indicating the time that medication was due to be taken. The invention is attached to a pill container having a cap. An image of a clock face and an indication of the time when the medication has been taken, or should be taken, may be printed or adhered to the top of the cap and/or to the bottom. A transparent, rotatable cover having an arrow indicator inscribed thereon, is placed over the cap. Another transparent cover, having an arrow indicator inscribed thereon, is placed over a clock face on the bottom for use as a second timer, reminder.

DESCRIPTION OF THE PREFERRED EMBODIMENT

Figure 1:
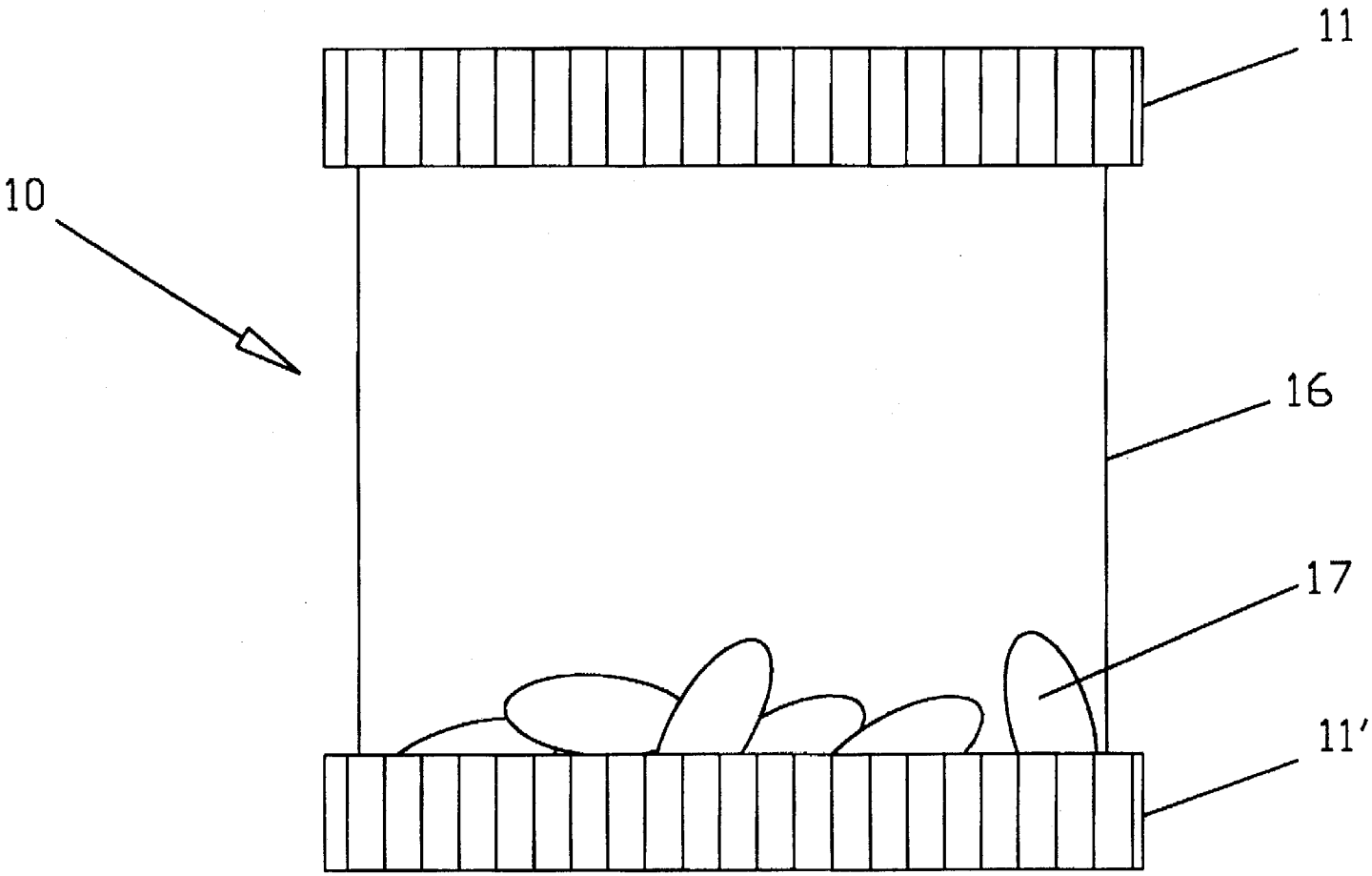
FIG. 1 is a side view of the prescription timer of the invention.
Figure 3:
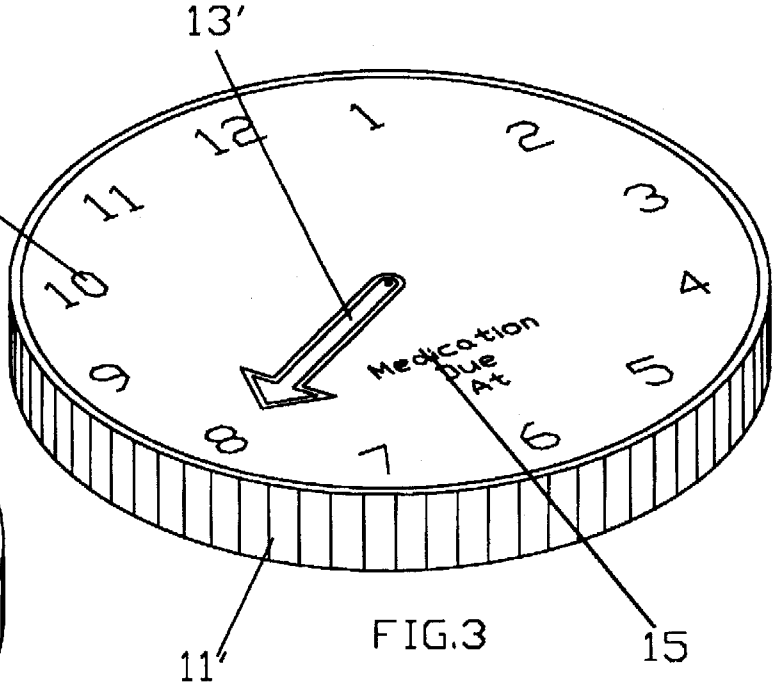
FIG. 3 is a top plan perspective view of a second indicator cap and a second image of a clock face of the invention.
Figure 2:
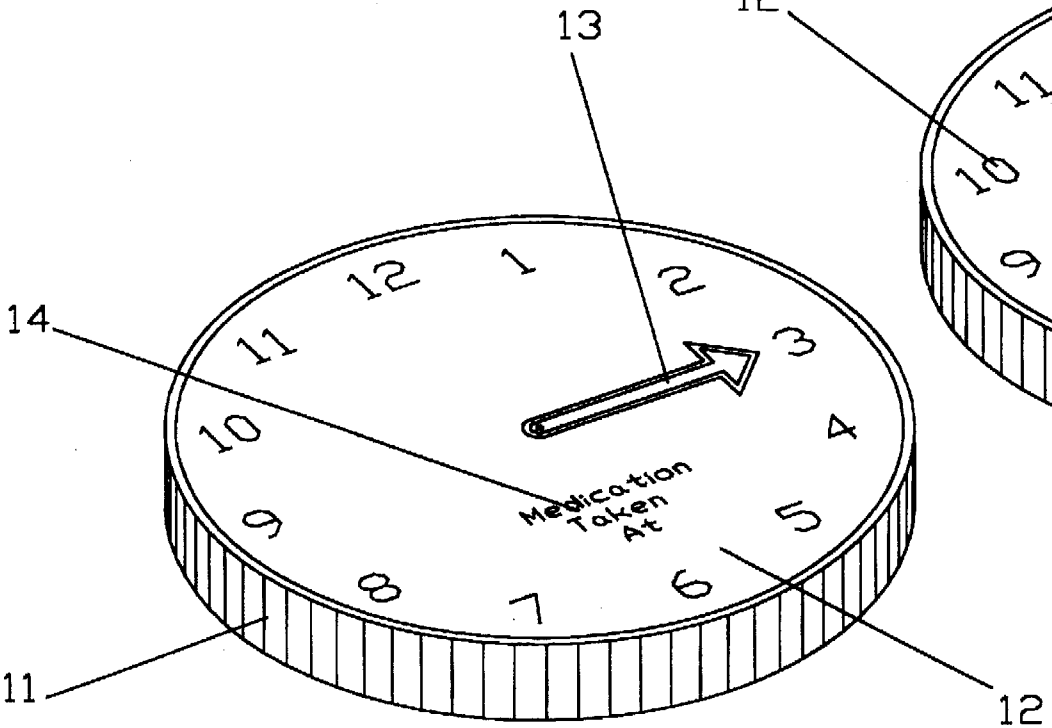
FIG. 2 is a top plan perspective view of the first indicator cap and the first image of a clock face of the invention.
Figure 4:
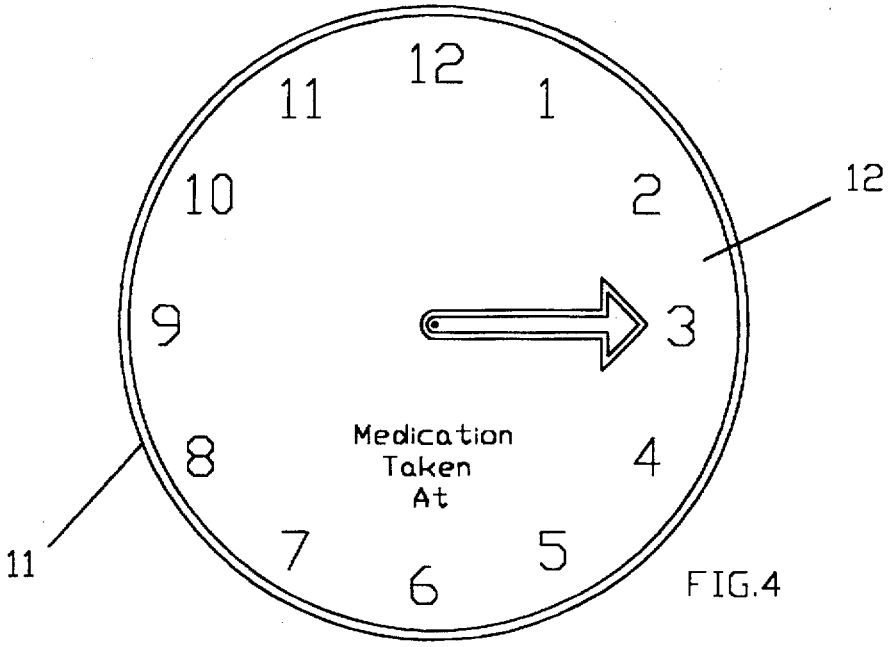
FIG. 4 is a top plan view of the first indicator cap and the first image of a clock face having an image of the time taken printed thereon.

Referring to FIG. 1, there is shown the prescription timer designated by the numeral 10 and showing first end cap 11, a second end cap 11', and medication bottle 16. The bottle 16 may preferably have a bottle cap 21 for securing a first end 24 (top end). The invention broadly comprises a first cap 11 having a first time indicator 13, and a second cap 11' having a second time indicator 13', a first CLOCK FACE image 12 and a second CLOCK FACE image 12', a MEDICATION TAKEN AT image 14, and a MEDICATION DUE AT image 15. The bottle cap 21 is formed with a flat surface 27. A clock face image 12 and a medication time image 14 or 15 may be imprinted or affixed to flat surface 27.

The second end 25 (bottom end), is adapted to hold an end cap 11' in a rotatable position, and also formed with a flat surface 26. A clock face image 12 and a medication time image 14 or 15 may be imprinted or affixed to the flat surface 26 of second end 25.

The medication bottle 16 is shown with pills 17 although a liquid may also be dispensed as well. The instant invention is conveniently attached to a pill bottle 16 or 23 by merely imprinting or placing the first CLOCK FACE image 12 and the second CLOCK FACE image 12' on opposite ends of the bottle 16 and slipping the first end cap 11 and second end cap 11' over their respective ends.

Figure 5:
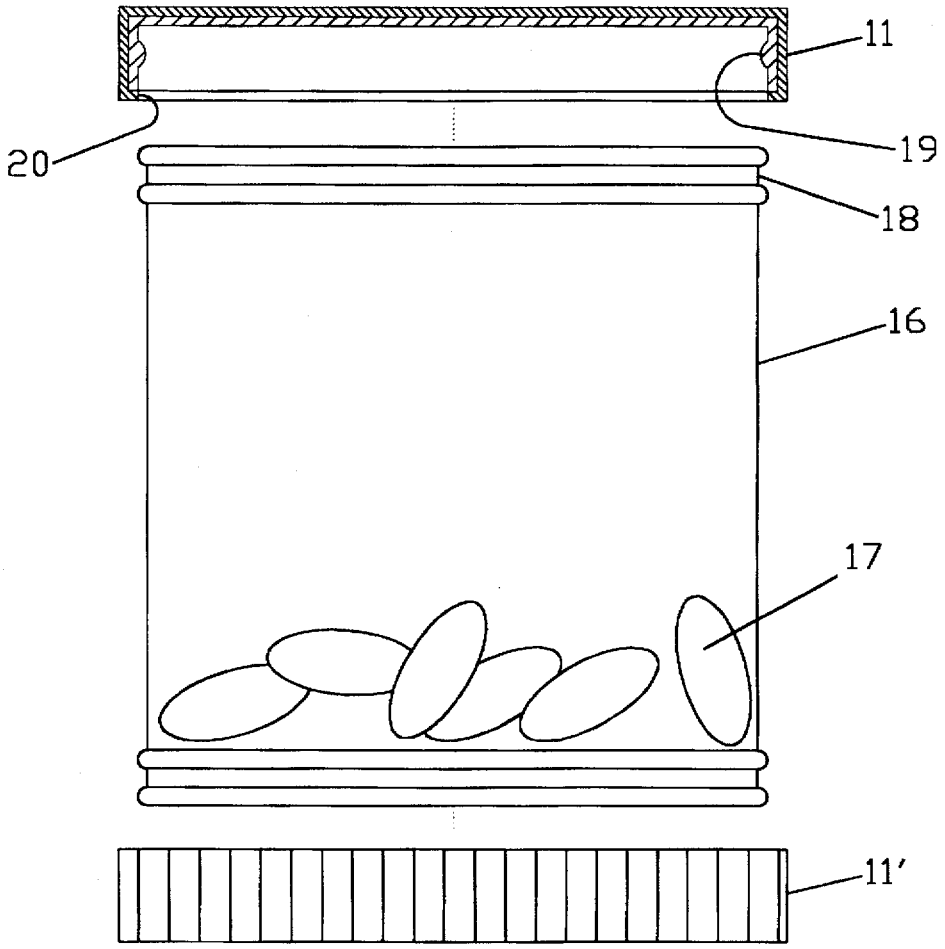
FIG. 5 is a side exploded view of the prescription timer of the invention.
Figure 6:
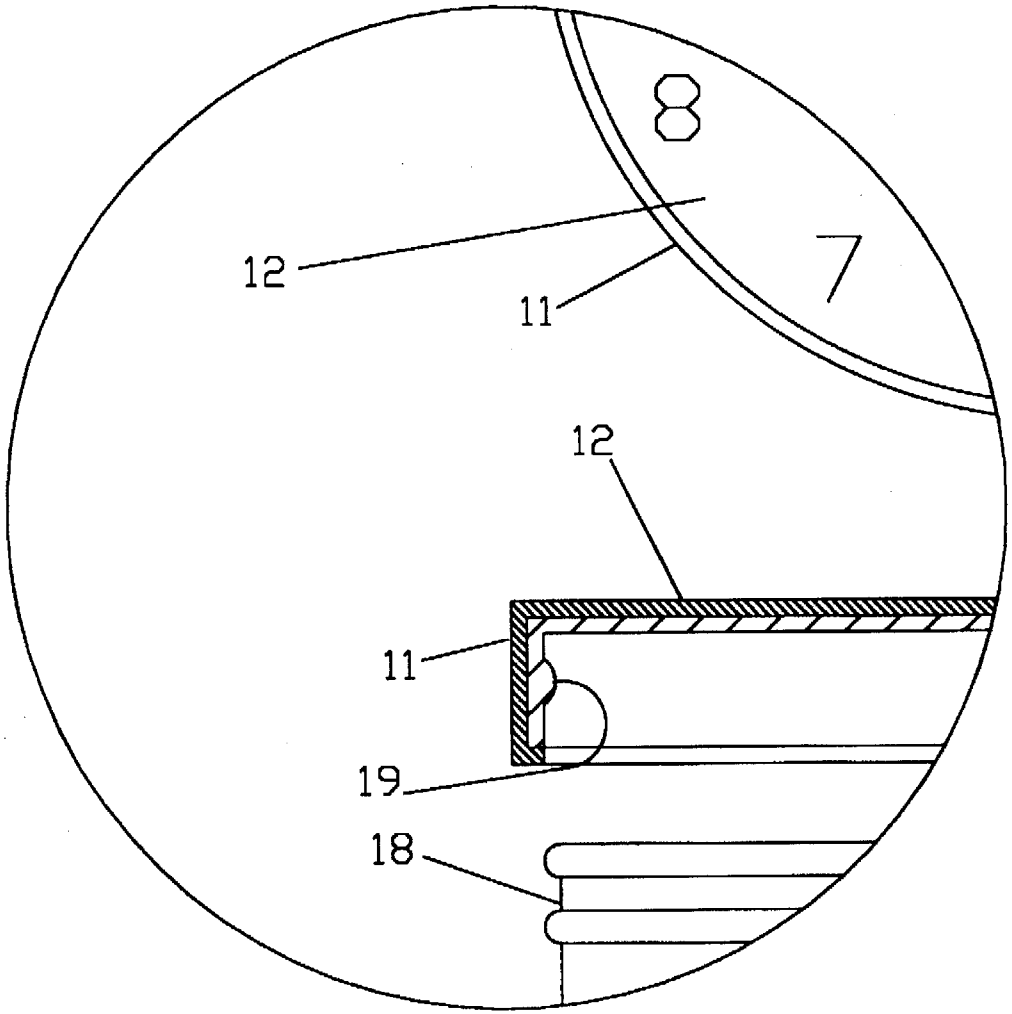
FIG. 6 is an exploded view, partially in section, of the cap fastening system.

FIGS. 5 and 6 show exploded views of the timer 10 with the bottle cap 21 removed. Bottle 16 contains a groove 18 for engagement by locking ridge 19 when the bottle 10 is closed. The groove 18 may also be shaped in the form of a screw thread (not shown) if a different type of fastener is desired. First end cap 11 is held on the bottle cap 21 by shoulder 20 formed on the lower edge of end cap 11 which fits over and grasps the bottle cap 21. The bottle cap 21 is sized to fit snugly over the bottle 16 to prevent slipping when the end cap 11 is turned to set either of the times provided. The end cap 11 is sized to slidably turn over bottle cap 21 when it is desired to change the time indicated by time indicator 13.

End caps 11 and 11' may be made of a clear plastic with the arrow indicator 13 either printed or inscribed thereon. The first end cap 11 is formed to fit over the bottle cap 21 and to be sufficiently tight to remain on the bottle cap 21 while at the same time to be easily turned by a person with arthritic fingers. The CLOCK FACE image 12 may be printed on a decal with a self adhesive surface and adhered to the top or bottom of the bottle 16.

Figure 8:
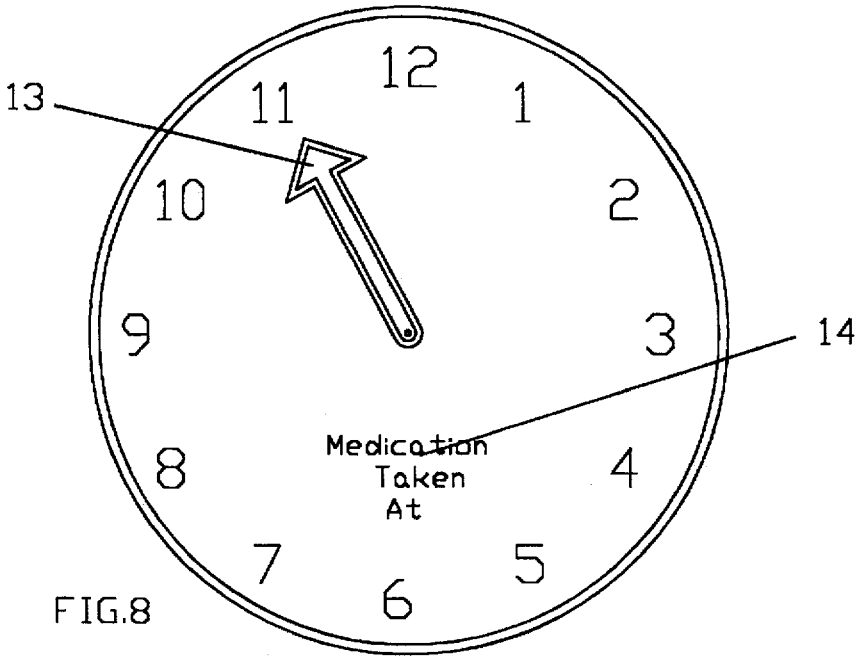
FIG. 8 is a top view of the top end cap and top end image of the time taken.
Figure 7:
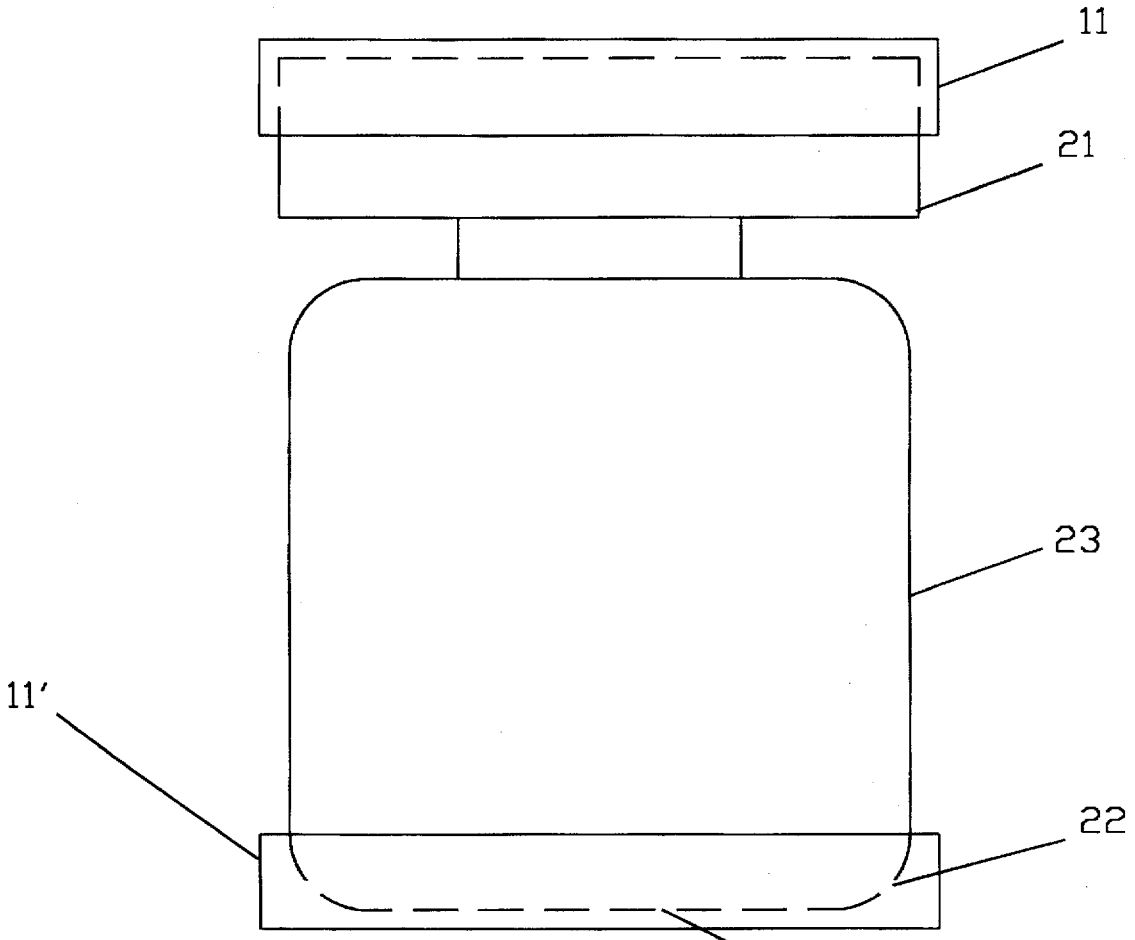
FIG. 7 is a side view of a second embodiment of the invention to fit a standard medicine bottle.

FIGS. 7 and 8 depict the invention used on a standard prescription bottle 23 having a bottle cap 21 which is either screwed on or fitted over the bottle 23 to secure the contents. MEDICATION TAKEN AT image 14 and CLOCK FACE image 12 are affixed to the bottle cap 21. First end cap 11 is then slid over the bottle cap 21. A second end cap 11' is placed over the end of the bottle 23 having the MEDICATION DUE AT image 15. Each of the images 14 or 15 may be interchanged if desired. The first end cap 11 is held on by slight friction caused by the size of the cap 11 and its relation to the bottle cap 21. The second end cap 22 is also held on by the slight friction caused by its size relative to the diameter of the bottle 23.

This embodiment may be readily adapted to existing prescription bottles and merely requires a range of different sizes to fit every bottle currently being manufactured and dispensed by pharmacists. With regard to the embodiment shown in FIG. 1, the size may be varied from a size large enough to hold a standard size prescription bottle, with the bottle placed inside and enclosed by the prescription timer 10 of the invention. Another embodiment may be reduced in size to become a pocket size (travel size) as a primary carrier of a limited supply of a prescription.

Some minor changes and modifications may vary to meet present and future prescription bottle requirements, the invention is not considered limited to the specific examples chosen for the purposes of illustration, and includes all changes and modifications which do not constitute a departure from the true spirit and scope of this invention as claimed in the following claims and reasonable equivalents to the claimed elements.

What is claimed is:

1. A system for indicating when a prescription medicine is taken and when it should be taken comprising:

a bottle for containing prescription medicine, said bottle having a first end and a second end, said first end having grooved cap engaging means, and said second end having a flat surface, a bottle cap placed over said engaging means for closing said bottle, said cap having a flat surface for receiving an image, an image of a clock face and a first medication time image placed on said bottle cap, a first end cap placed over said bottle cap and slidably rotatable on said bottle cap, said first end cap having an image of an arrow indicator formed thereon, an image of a clock face and a second medication time image placed on said second end flat surface, and a second end cap placed over said second end flat surface and slidably rotatable on said second end, said second end cap having an image of an arrow indicator formed thereon.

2. A system for indicating when a prescription medicine is taken and when it should be taken according to claim 1 wherein said first medication time image is the phrase MEDICATION TAKEN AT, and said second medication time image is the phrase MEDICATION DUE AT.

3. A system according to claim 2 wherein said medication time images are applied with a decal.

* * * * *